US008029100B2

(12) United States Patent
Anderson et al.

(10) Patent No.: US 8,029,100 B2
(45) Date of Patent: Oct. 4, 2011

(54) MICRO-FLUID EJECTION HEADS WITH CHIPS IN POCKETS

(75) Inventors: Frank Edward Anderson, Sadieville, KY (US); Jeanne Marie Saldanha Singh, Lexington, KY (US); Carl Edmond Sullivan, Stamping Ground, KY (US); Sean Terrence Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/765,259

(22) Filed: Apr. 22, 2010

(65) Prior Publication Data

US 2010/0199497 A1 Aug. 12, 2010

Related U.S. Application Data

(62) Division of application No. 11/536,470, filed on Sep. 28, 2006.

(51) Int. Cl.
*B41J 2/04* (2006.01)

(52) U.S. Cl. ..... 347/54; 430/320

(58) Field of Classification Search ..... 438/21; 347/54

See application file for complete search history.

(56) References Cited

U.S. PATENT DOCUMENTS

| | | | | |
|---|---|---|---|---|
| 6,109,719 | A * | 8/2000 | Cornell | 347/14 |
| 6,210,522 | B1 * | 4/2001 | Singh et al. | 347/50 |
| 6,366,468 | B1 * | 4/2002 | Pan | 361/761 |
| 6,409,312 | B1 * | 6/2002 | Mrvos et al. | 347/54 |
| 6,457,811 | B1 * | 10/2002 | Pan et al. | 347/50 |
| 6,530,649 | B1 * | 3/2003 | Pan | 347/56 |
| 7,121,647 | B2 * | 10/2006 | Smoot et al. | 347/50 |
| 7,169,538 | B2 * | 1/2007 | Bertelsen et al. | 430/320 |
| 7,254,890 | B2 * | 8/2007 | Barnes et al. | 29/890.1 |
| 7,404,613 | B2 * | 7/2008 | Kwan et al. | 347/20 |
| 2003/0035025 | A1 * | 2/2003 | Pan | 347/50 |
| 2003/0184618 | A1 * | 10/2003 | Childers et al. | 347/59 |
| 2005/0073552 | A1 * | 4/2005 | Smoot et al. | 347/50 |
| 2005/0200660 | A1 * | 9/2005 | Laurer et al. | 347/58 |
| 2006/0001713 | A1 * | 1/2006 | Kwan et al. | 347/86 |
| 2006/0057503 | A1 * | 3/2006 | Bertelsen et al. | 430/320 |
| 2006/0146092 | A1 * | 7/2006 | Barnes et al. | 347/54 |
| 2008/0079776 | A1 * | 4/2008 | Anderson et al. | 347/54 |

* cited by examiner

*Primary Examiner* — Charlie Peng
*Assistant Examiner* — Peter Radkowski

(57) ABSTRACT

Micro-fluid ejection heads and methods for fabricating micro-fluid ejection heads are provided, including those that use a non-conventional substrate and methods for making large array micro-fluid ejection heads. One such ejection head includes a substrate having a device surface with a plurality of fluid ejection actuator devices and a pocket disposed adjacent thereto. A chip associated with the plurality of fluid ejection actuator devices is attached in the chip pocket adjacent to the device surface of the substrate. A conductive material is deposited adjacent to the device surface of the substrate and in electrical communication with the chip.

8 Claims, 6 Drawing Sheets

MICRO-FLUID EJECTION HEADS WITH CHIPS IN POCKETS

This application claims the benefit and priority as a divisional application of parent application U.S. Ser. No. 11/536,470, filed Sep. 28, 2006.

TECHNICAL FIELD

The disclosure relates to micro-fluid ejection heads and, in one particular embodiment, to relatively large substrate ejection heads and methods for manufacturing such heads.

BACKGROUND AND SUMMARY

Conventional micro-fluid ejection heads are designed and constructed with silicon chips having both ejection actuators (for ejection of fluids) and logic circuits (to control the ejection actuators). However, the silicon wafers used to make silicon chips are only available in round format. In particular, the basic manufacturing process for silicon wafers is based on a single seed crystal that is rotated in a high temp crucible to produce a circular boule that is processed into thin circular wafers for the semiconductor industry.

The circular wafer stock is very efficient for relatively small micro-fluid ejection head chips relative to the diameter of the wafer. However, such circular wafer stock is inherently inefficient for use in making large rectangular silicon chips such as chips having a dimension of 2.5 centimeters or greater. In fact the expected yield of silicon chips having a dimension of greater than 2.5 centimeters from a circular wafer is typically less than about 20 chips. Such a low chip yield per wafer makes the cost per chip prohibitively expensive.

Accordingly, there is a need for improved structures and methods for making micro-fluid ejection heads, particularly ejection heads suitable for ejection devices having an ejection swath dimension of greater than about 2.5 centimeters.

In view of the foregoing and/or other needs, exemplary embodiments disclosed herein provide micro-fluid ejection heads and methods for making, for example, large array micro-fluid ejection heads. One such ejection head includes a substrate having a device surface with a plurality of fluid ejection actuator devices and a pocket disposed adjacent thereto. A chip associated with the plurality of fluid ejection actuator devices is attached in the pocket adjacent to the device surface of the substrate. A conductive material is adjacent to the device surface of the substrate and is in electrical communication with the chip.

Another exemplary embodiment disclosed herein provides a method for fabricating a micro-fluid ejection head. According to such a method, a chip is attached in a pocket adjacent to a device surface of a substrate and adjacent to a plurality of fluid ejection actuators that are adjacent to the device surface of the substrate. A blocking film is applied adjacent to the device surface of the substrate to span a gap between the chip and the device surface of the substrate. The gap is filled with a non-conductive material from a fluid supply surface of the substrate. The blocking film is removed and a conductive material is deposited adjacent to the device surface of the substrate and the filled gap for electrical connection to the chip.

Yet another exemplary embodiment disclosed herein provides another method for fabricating a micro-fluid ejection head. According to such a method, a chip is attached in a pocket adjacent to a device surface of a substrate and adjacent to a plurality of fluid ejection actuators that are adjacent to the device surface of the substrate. A conductive material is deposited adjacent to a device surface of the substrate. A support film is applied adjacent to the device surface of the substrate to span a gap between the chip and the device surface of the substrate. Another conductive material is deposited adjacent to the support film for electrical connection to the chip.

An advantage of the exemplary apparatus and methods described herein is that large array substrates, for example, may be fabricated from non-conventional substrate materials including, but not limited to, glass, ceramic, metal, and plastic materials. The term "large array" as used herein means that the substrate is a unitary substrate having a dimension in one direction of greater than about 2.5 centimeters. However, the apparatus and methods described herein may also be used for conventional size ejection head substrates.

Another advantage of exemplary embodiments disclosed herein is an ability to dramatically reduce the amount of semiconductor device area required to drive a plurality of fluid ejection actuators.

BRIEF DESCRIPTION OF THE DRAWINGS

Further advantages of the exemplary embodiments will be apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
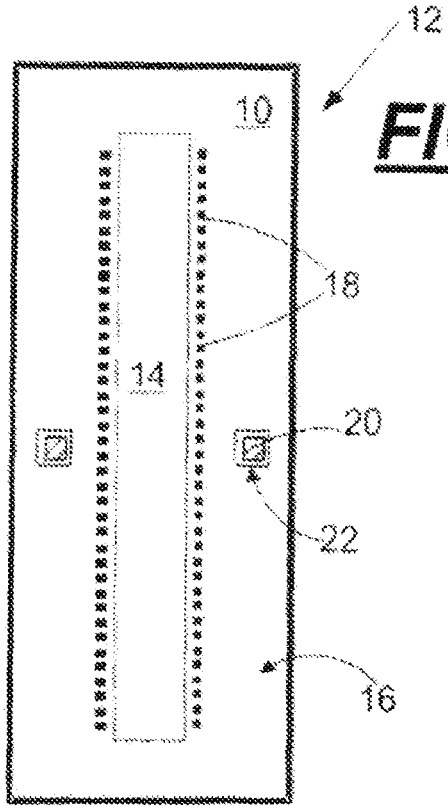
FIG. 1 is a plan view of a micro-fluid ejection head according to an exemplary embodiment as viewed from a device surface thereof.

As described in more detail below, exemplary embodiments disclosed herein relate to non-conventional substrates for providing micro-fluid ejection heads. Such non-conventional substrates, unlike conventional silicon substrates, may be provided in large format shapes to provide large arrays of fluid ejection actuators on a single substrate. Such large format shapes are particularly suited to providing page wide printers and other large format fluid ejection devices.

Accordingly, a base substrate 10 (FIGS. 1 and 2) for a micro-fluid ejection head 12 may be provided by materials such as glass, ceramic, metal, plastic, and combinations thereof. A particularly suitable material is a cast or machined non-monocrystalline ceramic material. Such material may be provided with dimensions of greater than about 2.5 centimeters and typically has electrically insulating properties suitable for use as the base substrate 10.

A fluid supply slot 14 may be machined or etched in the base substrate 10 by conventional techniques such as deep reactive ion etching, chemical etching, sand blasting, laser drilling, sawing, and the like, to provide flow communication from a fluid source to a device surface 16 of the substrate 10. A plurality of fluid ejection actuators 18, such as heater resistors or piezoelectric devices are provided adjacent to one or both sides of the fluid supply slot 14.

The fluid ejection actuators 18 may be associated with one or more semiconductor devices 20, referred to generically herein as "chips", such as those described in more detail below, that are attached in pockets 22 adjacent to the device surface 16 of the substrate 10. The chips may include, but are not limited to, a driver or demultiplexing device that is associated with the ejection head 12 to control one or more functions of the ejection head 12 or a device to provide an on-board memory for the ejection head 12. For the purposes of simplification, the semiconductor device 20 may be referred to herein as a driver device 20.

Figure 2:
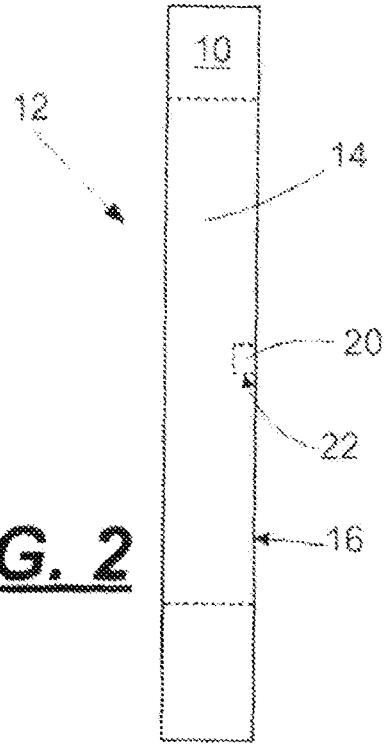
FIG. 2 is a side view of the micro-fluid ejection head of FIG. 1.
Figure 3A:
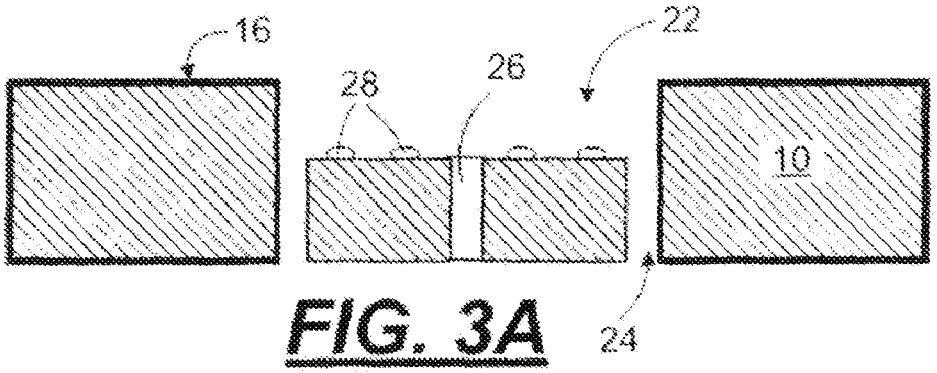
FIGS. 3A-7 are schematic views, in cross-section, of a first process for making a micro-fluid ejection head according to an exemplary embodiment.
Figure 3B:
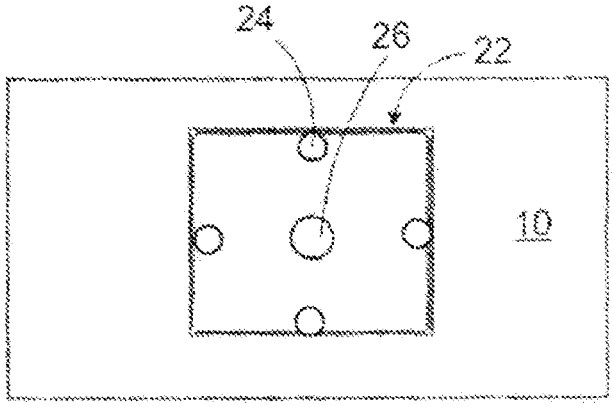

With reference to FIGS. 3-13, methods for fabricating micro-fluid ejection heads, such as ejection head 12 will now be described. FIG. 3A is an enlarged, cross-sectional view, not to scale, of the pocket 22 for the driver device 20 illustrated in FIGS. 1 and 2. FIG. 3 B is an enlarged plan view of the pocket 22 showing fill ports 24 and a conductive plug port 26 in the pocket 22. In the embodiment illustrated in FIGS. 3-7, the pocket 22 is a recessed area that may be machined or etched in the device surface 16 of the substrate 10. Likewise, one or more fill ports 24 and a conductive plug port 26 may be machined or etched through the substrate 10, for example, such as for the purpose described in more detail below. Stand off or spacer devices 28 may be included in the pocket 22, such as to provide proper height adjustment of a top surface of the driver device 20 and/or for providing a suitable amount of adhesive to attach the driver device 20 in the pocket 22.

Figure 4:
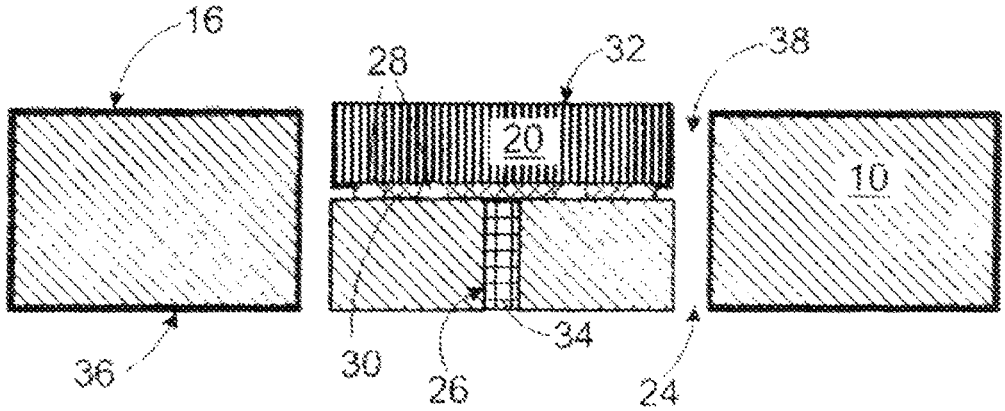

FIG. 4 illustrates a step of attaching the driver device 20 in the pocket 22 (FIG. 3). The driver device 20 is attached in the chip pocket 22 such as by use of an adhesive, suitably a conductive adhesive 30. The spacer devices 28 may be used to provide sufficient space for the adhesive 30 and to enable adhesively attaching the driver device 20 so that a surface 32 of the driver device 20 is substantially coplanar with the device surface 16 of the substrate. A conductive plug 34 may be disposed in the conductive plug port 26 for electrical flow communication between the driver device 20 and a fluid supply surface 36 of the substrate 10. The conductive plug 34 may be deposited in the conductive plug port 26 before or after attaching the driver device 20 in the pocket 22.

Figure 5:
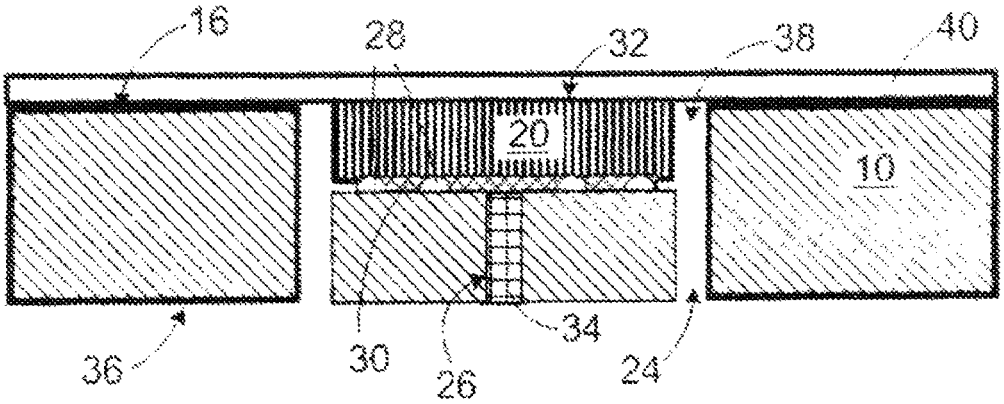
Figure 6:
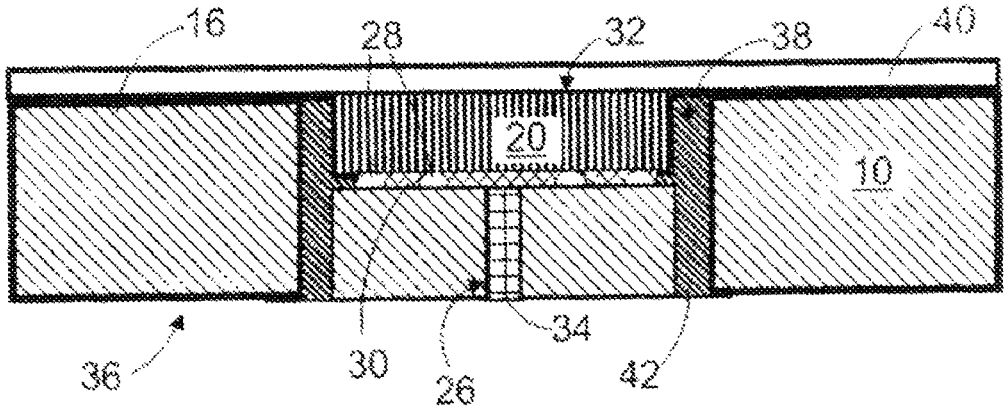
Figure 7:
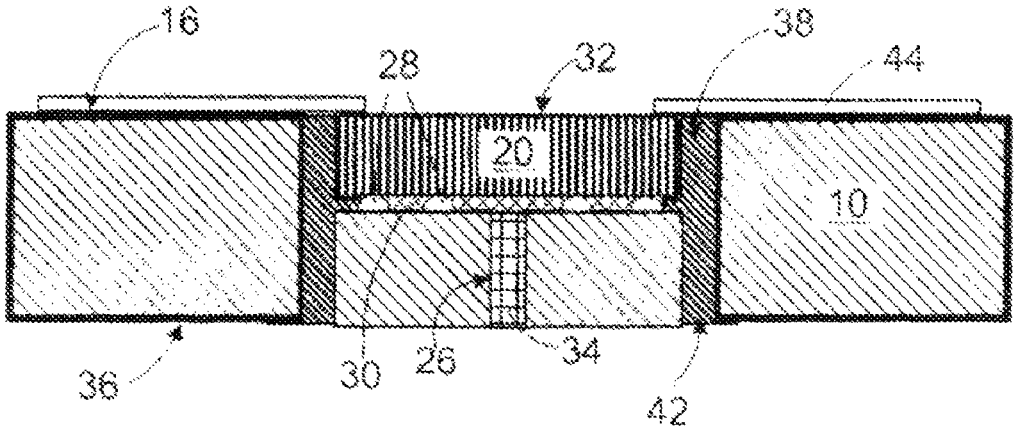

It will be appreciated that there is a gap 38 between the driver device 20 and the device surface 16 of the substrate 10. Gap 38 makes it difficult to print or deposit a thin conductive metal layer adjacent to the device surface 16 and the surface 32 of the driver device 20. Accordingly, FIGS. 5-7 illustrate steps that may be used to provide a planarized surface for deposition of the thin conductive metal layer. As shown in FIG. 5, a blocking film 40 may be applied (e.g., laminated) adjacent to the device surface 16 and surface 32 so that the blocking film spans any gaps 38 in the pocket 22 between the driver device 20 and the substrate 10. In an exemplary embodiment, the blocking film 40 may be, for example, a thermo plastic material selected from the group consisting of polypropylene, polyethylene, polyethylene terephthalate, polyurethane, or other thermoplastic polyolefins, or the blocking film 40 may be selected from a negative photoresist dry film available from DuPont Printed Circuit Materials, of Research Triangle Park, NC under the trade name RISTON or a positive dry film photoresist material. The blocking film 40 may be removably attached adjacent to the device surface 16 and surface 32 to enable filling of the gaps 38 with a relatively low viscosity filler material such as a low viscosity adhesive 42. The low viscosity adhesive 42 may be inserted in the gaps 38 through the fill ports 24 in the substrate 10. Once the adhesive 42 has hardened, the film 40 may be removed from the substrate 10 and device 20.

Next, as shown in FIG. 7, a first metal conductive layer 44, for example, may be deposited adjacent to the device surface 16 for attachment to the device 20 for electrical communication between the ejection actuators 18, the device 20, and a power or control device, such as a printer. The first metal conductive layer 44 may be deposited by a wide variety of techniques, including, but not limited to micro-fluid jet ejection, sputtering, chemical vapor deposition, and the like.

Figure 8:
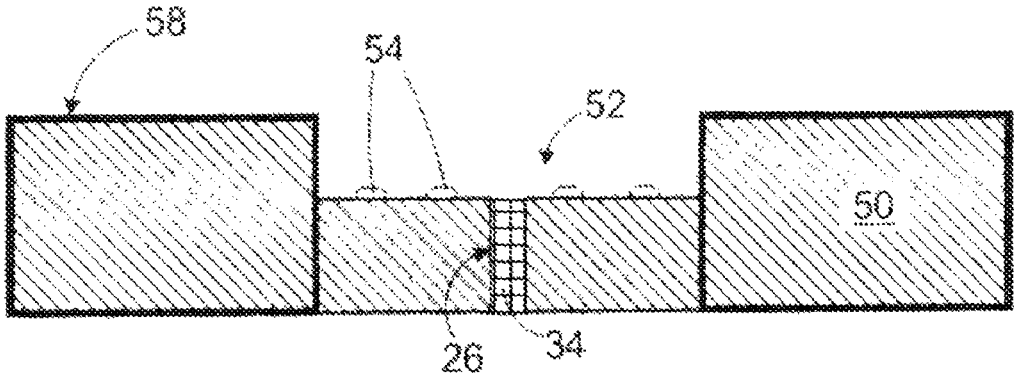
FIGS. 8-13 are schematic views, in cross-section, of a second process for making a micro-fluid ejection head according to another embodiment.

In another embodiment, illustrated in FIGS. 8-13, the fill ports 24 (FIGS. 3-5) in the substrate 10 are not required. As shown in FIG. 8, the substrate 50 also includes a pocket 52 and spacer devices 54 as described above. Other features such as a conductive plug port 26 may be included such as for the purposes described above.

Figure 9:
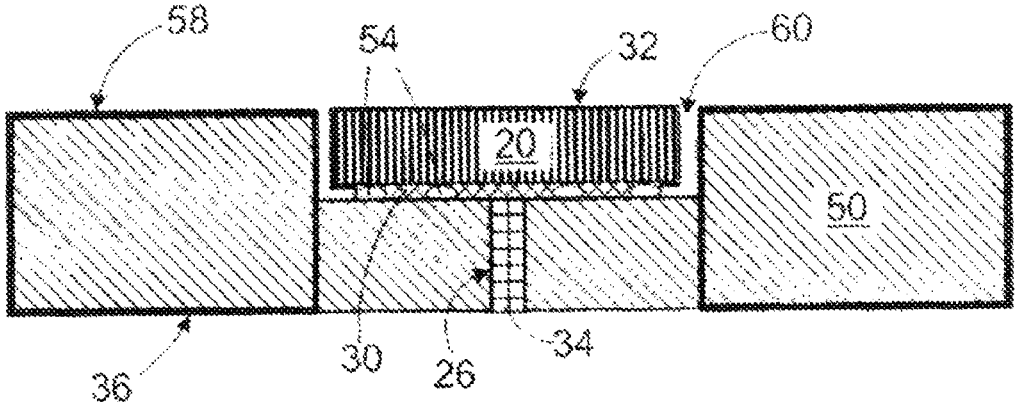
Figure 10:
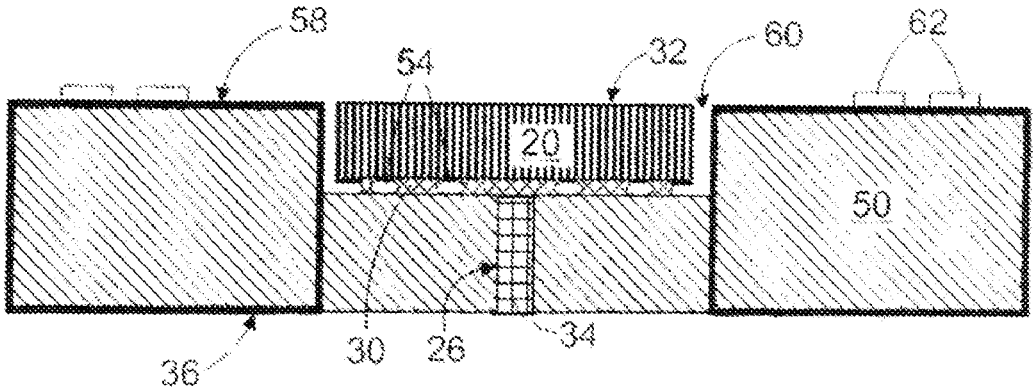
Figure 11:
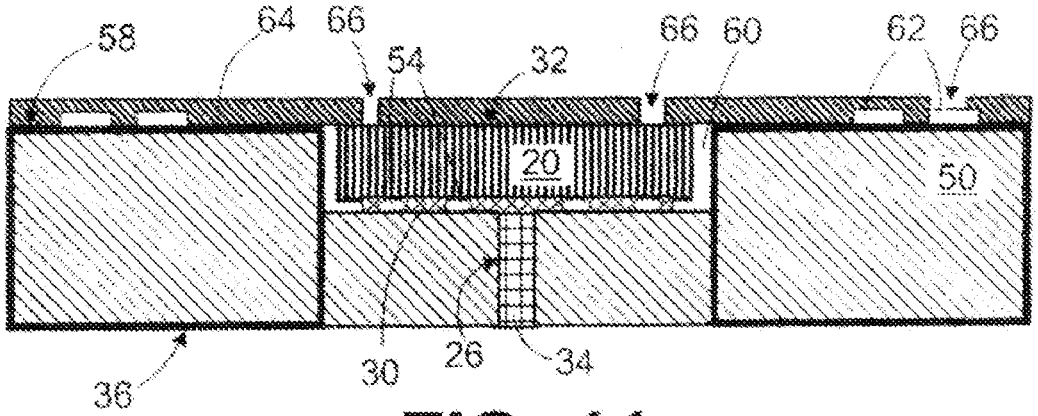
Figure 12:
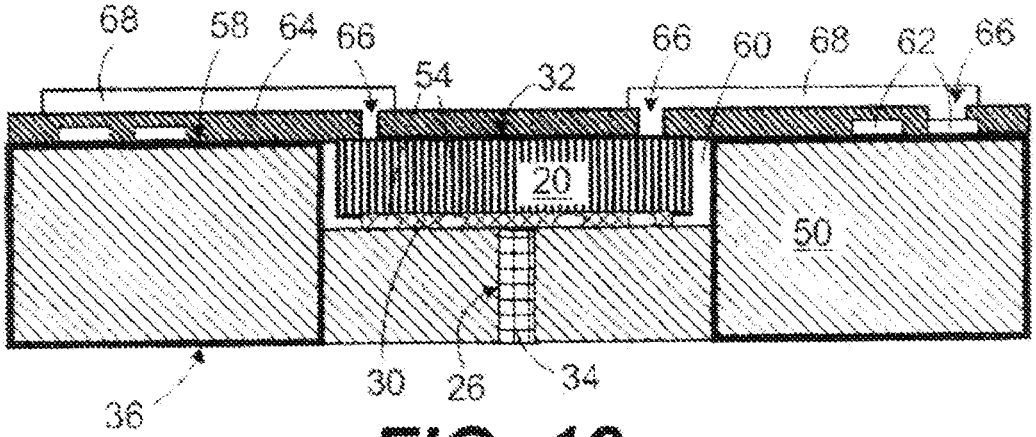

In FIG. 9, the device 20 has been attached in the pocket 52 adjacent to a device surface 58 of the substrate 50 such as by the use of the conductive adhesive 30 described above. As in the previous embodiment, there are gaps 60 between the device 20 and the substrate 50. However, unlike the previous embodiment, a first metal layer providing conductive traces 62 (FIG. 10) is deposited only on the device surface 58 of the substrate 50. The first metal layer providing the conductive traces 62 may be deposited in the same manner as the first metal conductive layer 44 described above with reference to FIG. 7.

In order to provide electrical connection of the conductive traces 62 to the device 20, a support film 64, similar to film 40 (FIGS. 5-6), may be applied (e.g., laminated to or deposited) adjacent to the device surface 58 and surface 32 as described above. The film 64 may then be photoimaged and developed or otherwise etched to provide openings 66 therein. As with the previous embodiment, the support film 64 is disposed adjacent to the device surface 58 of the substrate 50 so that it spans the gaps 60 between the device 20 and the substrate 50.

Figure 13:
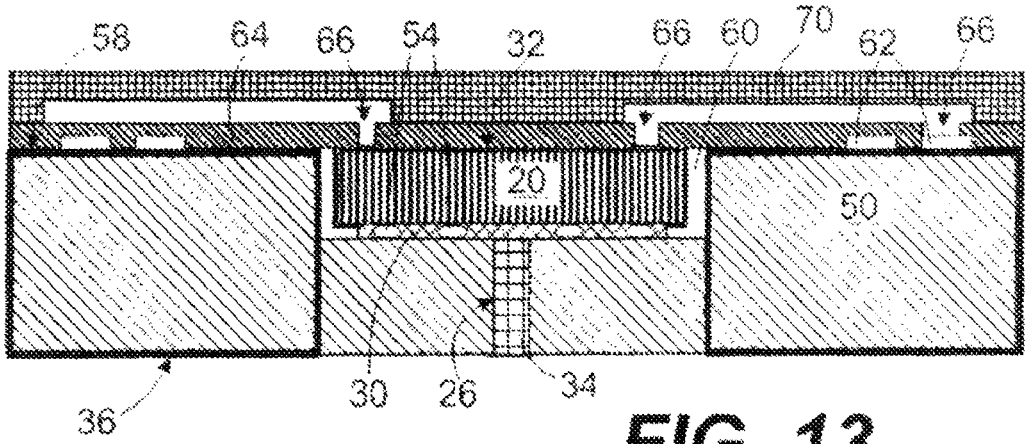

Next, a second metal conductive layer 68 may be deposited adjacent to the support film 64. The second metal conductive layer 68 may be deposited by techniques similar to the techniques used to deposit the conductive traces 62 and conductive layer 44 described above to provide electrical communication between the conductive traces 62 and the device 20. In FIG. 13, a nozzle plate material 70 has been deposited or attached adjacent to the device surface 58 of the substrate 50 to provide nozzles for the actuator devices 18 (FIG. 1). The nozzle plate material 70 may be, for example, any conventional nozzle plate material known to those skilled in the art.

Figure 14A:
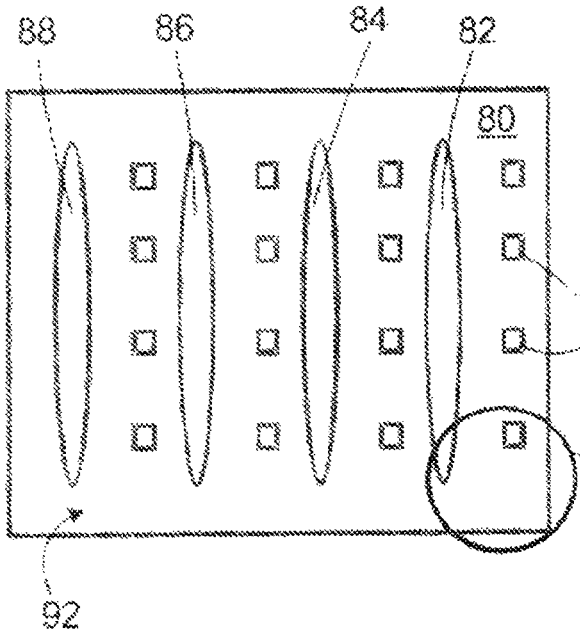
FIG. 14A is a plan view of a micro-fluid ejection head viewed from a device surface thereof having multiple fluid supply slots and multiple pockets for multiple device drivers for fluid actuation devices adjacent to the slots for one exemplary embodiment.
Figure 14B:
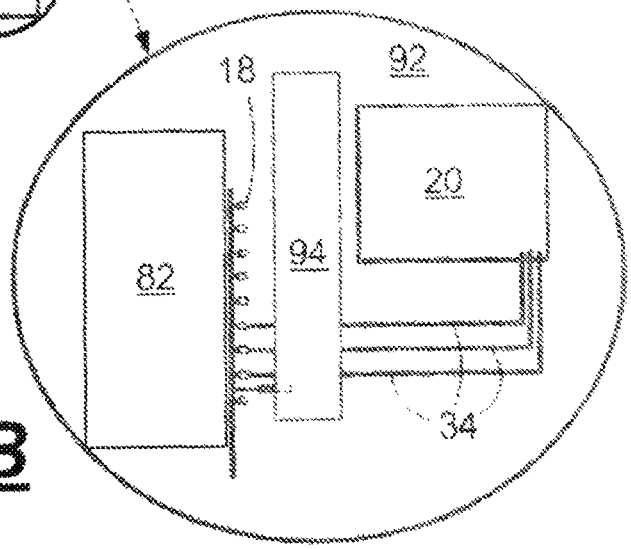
FIG. 14B is an electrical routing scheme for fluid actuator devices adjacent to one of the fluid supply slots for an ejection head having multiple driver devices for ejection actuators for a single fluid supply slot according to the embodiment of FIG. 14A.
Figure 14C:
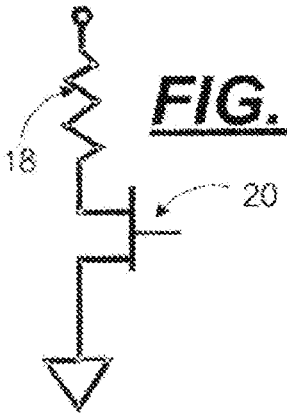
FIG. 14C is an electrical schematic for the electrical routing scheme of FIG. 14C.

According to one exemplary embodiment of the disclosure illustrated in FIGS. 14A-14C, substrate 80 may be configured to include a plurality of fluid supply slots 82-88 and associated driver devices 20, as described above, for control of a plurality of ejection actuators 18 adjacent to the slots 82-88.

FIG. 14B is an enlarged view of a single driver device 20 illustrating routing of a first metal conductive layer 44 from the device 20 to the ejection actuators 18. The layer 44 is deposited adjacent to a device surface 92 of the substrate 80 and connected to the device 20, such as by the method of the first or second embodiment described above with reference to FIGS. 3-13. An opposite side of the ejection actuators 18 may be electrically connected to a ground or power bus 94, such as one also deposited adjacent to the device surface 92 of the substrate. In this embodiment, each device 20 may be used to control from about 64 to about 512 actuators 18, with an optimum number of actuators 18 controlled by each device 20 being about 128 or 256. Accordingly, a plurality of devices 20, as shown in FIG. 14A are typically required for fluid slots 82-88, each slot 82-88 feeding from about 150 to about 2400 actuators 18. A wiring schematic for such an embodiment is illustrated in FIG. 14C.

Figure 15C:
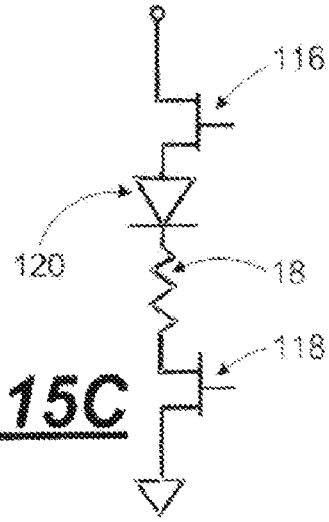
FIG. 15C is an electrical schematic for the electrical routing scheme of FIG. 15B.
Figure 15A:
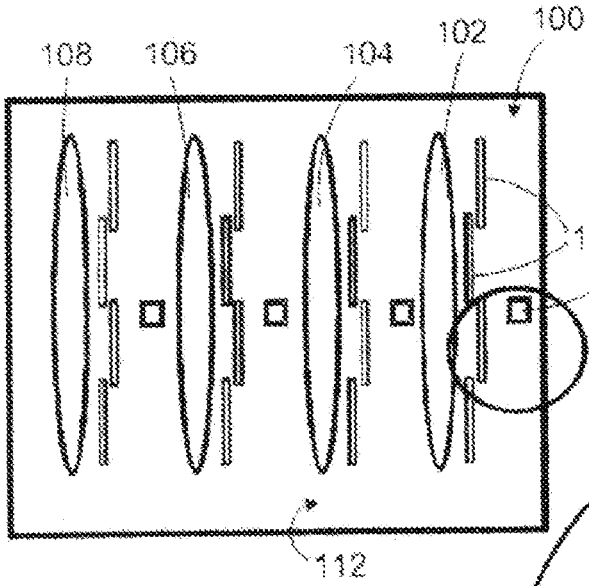
FIG. 15A is a plan view of a micro-fluid ejection head viewed from a device surface thereof containing multiple fluid supply slots and a reduced number of driver devices for fluid actuation devices adjacent to the slots according to another embodiment.
Figure 15B:
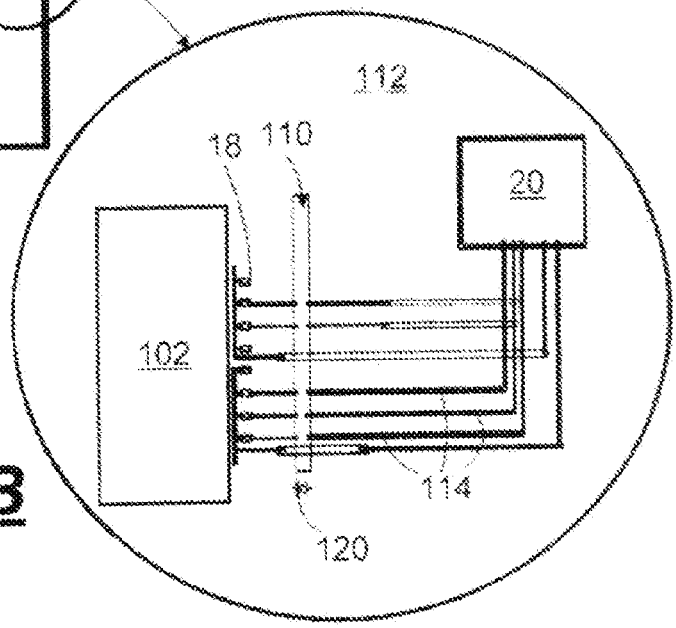
FIG. 15B is an electrical routing scheme for fluid actuator devices adjacent to one of the fluid supply slots for an ejection head having a reduced number driver devices for ejection actuators for a single fluid supply slot according to the embodiment of FIG. 15A.

In another embodiment, illustrated in FIGS. 15A-15C, a circuit configuration is provided that may significantly reduce the size and amount of semiconductor devices 20 that are attached to a device surface of a non-conventional substrate 100. In this embodiment, a single device 20 controls all of the ejection actuators 18 adjacent to each of the fluid supply slots 102-108. As before, the device 20 is attached to the substrate 100 in a pocket 22 and electrical connections to the device 20 are provided such as by one of the methods described with reference to FIGS. 3-13 above. However, unlike the previous embodiment, a plurality of diode arrays 110 may be deposited adjacent to a device surface 112 of the substrate 100, such as in order to reduce the number of conductive traces 114 required between the ejection actuators 18 and the driver device 20. The diode arrays 110 may provide a matrix control scheme of row and column FET devices 116 and 118 in the driver device 20 that may be used to select the ejection actuators 18 for firing. A wiring schematic for such an embodiment is illustrated in FIG. 15C. Compared to the embodiment illustrated in FIGS. 14A-14C, the embodiment of FIGS. 15A-15C may require about 75 percent less semiconductor material for the ejection head, thereby significantly lowering the cost to produce such large array ejection heads. However, this embodiment may require one diode 120 to be deposited adjacent to the substrate 100 for each ejection actuator 18.

In a further embodiment, a substrate for the ejection head may be selected from a metal such as tantalum, titanium aluminum, stainless steel, and the like, with a thin electrically insulating oxide layer deposited or formed adjacent to a device surface of the substrate. In such an embodiment, the substrate may provide both thermal conductivity properties as well as a ground plane for electrical connection between the actuators and/or driver device. In all other respects, the metal substrate may be configured in a manner set forth herein to provide control of the actuator devices deposited thereon.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present invention(s) be determined by reference to the appended claims.

What is claimed is:

1. A method for fabricating a micro-fluid ejection head, comprising:

attaching a chip in a pocket adjacent to a device surface of a substrate and adjacent to a plurality of fluid ejection actuators that are adjacent to the device surface of the substrate, the pocket being on a same side of the substrate as the device surface;

planarizing the device surface and the chip in the pocket;

applying a blocking film adjacent to the device surface of the substrate to span a gap between the chip and the device surface of the substrate;

filling the gap between the chip and the device surface of the substrate with a non-conductive material from a fluid supply surface of the substrate;

removing the blocking film; and depositing a conductive material adjacent to the device surface of the substrate and the filled gap for electrical connection to the chip, the conductive material to provide the electrical connection in a planarized layer between the chip and the fluid ejection actuator devices on said same side of the substrate.

2. The method of claim 1, further comprising attaching a nozzle plate adjacent to the device surface of the substrate.

3. The method of claim 1, wherein the chip is attached in the pocket using a conductive adhesive.

4. The method of claim 1, further comprising depositing a conductive material in a conductive plug port in the pocket to electrically connect the chip with the fluid supply surface of the substrate.

5. A method for fabricating a micro-fluid ejection head, comprising:

attaching a chip in a pocket adjacent to a device surface of a substrate and adjacent to a plurality of fluid ejection actuators that are adjacent to the device surface of the substrate, the pocket being on a same side of the substrate as the device surface;

planarizing the device surface and the chip in the pocket;

depositing a conductive material adjacent to the device surface of the substrate;

applying a support film adjacent to the device surface of the substrate to span a gap between the chip and the device surface of the substrate; and depositing another conductive material adjacent to the support film for electrical connection to the chip, the another conductive material to provide the electrical connection in a planarized layer between the chip and the fluid ejection actuator devices on said same side of the substrate.

6. The method of claim 5, further comprising inserting a relatively low viscosity filler material in the gap.

7. The method of claim 6, wherein the relatively low viscosity filler material is inserted in the gap through a fill port in the substrate.

8. The method of claim 5, further comprising removing the support film from the substrate.

* * * * *